US005598177A

United States Patent [19]

Mizukata et al.

[11] Patent Number: 5,598,177

[45] Date of Patent: Jan. 28, 1997

[54] DRIVING APPARATUS AND METHOD FOR AN ACTIVE MATRIX TYPE LIQUID CRYSTAL DISPLAY APPARATUS

[75] Inventors: Katsuya Mizukata, Nara; Takafumi Kawaguchi, Yamatotakada; Shiro Takeda, Tenri; Makoto Takeda, Nara, all of Japan

[73] Assignee: Sharp Kabushiki Kaisha, Osaka, Japan

[21] Appl. No.: 361,460

[22] Filed: Dec. 21, 1994

Related U.S. Application Data

[63] Continuation of Ser. No. 961,280, Oct. 16, 1992, abandoned.

[30] Foreign Application Priority Data

Oct. 22, 1991 [JP] Japan ..... 3-274331

[51] Int. Cl.[6] ..... G09G 3/36

[52] U.S. Cl. ..... 345/92; 345/95

[58] Field of Search ..... 340/784, 805, 340/811; 358/236; 359/55, 57, 54, 59, 84, 85; 345/94, 92, 97, 95

[56] References Cited

U.S. PATENT DOCUMENTS

| | | | |
|---|---|---|---|
| 4,651,148 | 3/1987 | Takeda et al. | 345/92 |
| 4,795,239 | 1/1989 | Yamashita et al. | 359/57 |
| 4,929,058 | 5/1990 | Numao | 359/55 |
| 4,932,759 | 6/1990 | Toyoro et al. | 345/97 |
| 5,151,805 | 9/1992 | Takeda et al. | 340/784 |

FOREIGN PATENT DOCUMENTS

| | | |
|---|---|---|
| 0079496 | 5/1983 | European Pat. Off. . |
| 0373565 | 6/1990 | European Pat. Off. . |
| 60-57391 | 4/1985 | Japan . |
| 60-134293 | 7/1985 | Japan . |

OTHER PUBLICATIONS

*IBM Technical Disclosure Bulletin,* vol. 33, No. 9, Feb. 1991, pp. 309–310, "Gate Drive Scheme for Thin Film Transistor/Liquid Crystal Displays" EPO Search Report.

*The March '89 issue of TV Technology,* pp. 19–25, N. Takeda et al: "The Principle of a Liquid Crystal Display and the Present State Thereof" with Partial English Translation.

*Primary Examiner*—Jeffery Brier

*Attorney, Agent, or Firm*—Nixon & Vanderhye P.C.

[57] ABSTRACT

A driving method of the invention is suitable for an active matrix type liquid crystal display apparatus having row and column electrodes. The driving method includes the steps of applying a gate-one pulse for writing data for one line to the column electrodes to each of the row electrodes. The gate-on pulse has a pulse waveform which includes at least one concave portion during a horizontal period.

14 Claims, 6 Drawing Sheets

DRIVING APPARATUS AND METHOD FOR AN ACTIVE MATRIX TYPE LIQUID CRYSTAL DISPLAY APPARATUS

This is a continuation of application Ser. No. 07/961,280, filed Oct. 16, 1992, now abandoned.

BACKGROUND OF THE INVENTION

1. Field of the Invention

The present invention relates to a driving apparatus and method for an active matrix type liquid crystal display (LCD) apparatus having row and column electrodes in a lattice arrangement, picture element electrodes for display located in regions defined by the row and column electrodes in a matrix arrangement, and switching transistors connected to the picture element electrodes and the row and column electrodes.

2. Description of the Prior Art

FIG. 3 shows an exemplary active matrix type LCD apparatus of 4×4 matrix. Row electrodes (gate electrode wirings) 1–4 and column electrodes (source electrode wirings) 5 are arranged in a lattice in the row and column directions. In regions defined by the row and column electrodes, picture element electrodes 20 are arranged in a matrix. At each of the crossings of the row and column electrodes, a switching transistor 10 is provided. For the switching transistor 10, for example, a thin film transistor (TFT) is used. Gate terminals 11 of the switching transistors 10 are respectively connected to the row electrodes 1–4. Source terminals 12 of the switching transistors 10 are connected to the column electrodes 5, and drain terminals 13 thereof are connected to the corresponding picture element electrodes 20.

The column electrodes 5 are connected to a column electrode driving circuit 40. The column electrode driving circuit 40 periodically and sequentially applies data for one line to the column electrodes 5. When the switching transistors 10 are turned ON by a pulse applied from a row electrode driving circuit 30 to the row electrodes 1–4, a signal VS applied to each of the column electrodes 5 is applied to each of the picture element electrodes 20. By sequentially scanning a pulse applied from the row electrode driving circuit 30 to the row electrodes 1–4, and by varying column electrode data in synchronism with the timing, and image is displayed on the active matrix type LCD apparatus.

FIG. 4 schematically shows a configuration of the row electrode driving circuit 30. The row electrode driving circuit 30 includes a shift register 31, and four AND gates 32 respectively connected to output terminals Q1, Q2, Q3, and Q4 of the shift register 31. The shift register 31 inputs data SP at a data terminal (a terminal D) and a clock pulse CL at a clock terminal (a terminal CK), and shifts the data SP in accordance with the clock pulse CL. As a result, the shift register 31 outputs the shifted data SP to the AND gates 32 at the respective output terminals Q1, Q2, Q3, and Q4. The clock pulse CL and a LOW signal are also input into the AND gates 32. The AND gates 32 AND these input signals, and output gate-on pulses VG1–VG4 onto the row electrodes 1–4, respectively.

FIG. 5 shows waveforms of signals. Hereinafter, a waveform indicated by (N) in a figure is referred to as an Nth waveform. For example, in FIG. 5, the first to fourth waveforms shows those of the gate-on pulses VG1–VG4, the fifth waveform shows that of the clock pulse CL, the sixth waveform shows that of the data SP, and the seventh waveform shows that of the LOW signal.

Conventionally, each of the gate-on pulses VG1–VG4 applied to the row electrodes 1–4 is a one-shot pulse, as shown by the first to fourth waveforms in FIG. 5. The gate-on pulses have a waveform including an HI (high level) period and a LOW (low level) period. During the HI period, the corresponding switching transistor 10 is in an ON state, and during the LOW period, the corresponding switching transistor 10 is in an OFF state. As a result, only during the HI period of each of the gate-on pulses VG1–VG4, the signal VS shown by the eighth waveform in FIG. 5 is applied to the picture element electrodes 20 connected to the respective row electrodes 1–4 through the corresponding switching transistors 10. Accordingly, electrical charges are charged in a liquid crystal layer as a display medium of picture elements. The electrical charges are held in the liquid crystal layer during the LOW period of the gate-on pulses VG1–VG4, and each of the picture elements exhibits a transmissivity depending on the voltage applied to the picture element.

According to the conventional driving method shown in FIG. 5, in order to prevent the liquid crystals from deteriorating due to a DC voltage applied to an LCD apparatus, the polarity of the applied voltage is inverted for every line (for each of the row electrodes 1–4). In other words, a 1H inversion (the polarity is inverted every one horizontal period) system is adopted. The 1H period (one horizontal period) coincides with a period of a National Television System Committee (NTSC) television signal (1H=63.5 μs).

When the gate-on pulse VG1 of the first waveform in FIG. 5 is applied to the row electrode 1 in FIG. 3, and the signal VS of the eighth waveform in FIG. 5 is applied to the column electrode 5 in FIG. 3, according to the driving method mentioned above, the potential of a picture element electrode 20 at the crossing of the row and column electrodes 1 and 5 varies. If the gate-on period is sufficiently long, the liquid crystal layer is sufficiently charged. The potential variation VLC of the picture element 20 at the crossing is saturated, as shown by the ninth waveform in FIG. 5.

In order to increase the scanning speed for improving the functionality of the LCD apparatus, it is necessary to shorten the gate-on period. However, if the gate-on period is shortened, the liquid crystal layer is insufficiently charged. This results in an insufficient voltage application to the liquid crystal layer, and causes problems in displaying an image as follows.

For example, we consider the case of the transmission type LCD apparatus of a normally white system (during no voltage application: white (light is transmitted), during voltage application: black (light is shielded)). As the scanning speed is increased, the gate-on time period is not sufficient. This causes a short of charge phenomenon in which sufficient voltage is not applied to the liquid crystal layer. As a result, there arises problems in that the resulting display is whitish and a sufficient display contrast cannot be obtained, as compared with the case where the charging is sufficiently performed by applying a voltage of the same level to a column electrode.

The above-mentioned problems are specifically shown by a ninth waveform in FIG. 6. FIG. 6 shows signal waveforms in a driving method, one horizontal scanning period is set to be one-half of the period of the NTSC television signal. The gate-on pulses VG1–VG4 respectively shown by first to fourth waveforms in FIG. 6 are applied to the row electrodes 1–4. The gate-on pulses VG1–VG4 are produced by inputting a clock pulse CL of a fifth waveform, data SP of a sixth waveform, and a LOW signal of a seventh waveform in FIG. 6 into the respective input terminals of the row electrode driving circuit 30. The signal VS shown by an eighth waveform in FIG. 6 indicates a signal to be applied to the column electrodes 5 shown in FIG. 3.

A ninth waveform VLC in FIG. 6 represents the variation in potential applied to a picture element electrode 20 at the crossing of the row electrode 1 and the column electrode 5, when the signal VS shown by the eighth waveform in FIG. 6 is applied to the column electrode 5. Since the gate-on period of the gate-on pulse of the first waveform is shorter than that of the first waveform shown in FIG. 5, the charge to the liquid crystal layer is not sufficient. As a result, the potential of VLC cannot reach a sufficient level.

The potential of VLC should reach the level indicated by a broken line of the ninth waveform in FIG. 6. However, in actuality the potential of VLC only reaches the level indicated by the solid line thereof.

For the reasons mentioned above, there arises a problem that display contrast sufficient for the display quality of the LCD apparatus cannot be obtained according to the driving method shown in FIG. 6.

SUMMARY OF THE INVENTION

The driving apparatus and method of this invention for an active matrix type liquid crystal display apparatus having row and column electrodes includes the step of applying a gate-on pulse for writing data for one line to the column electrodes to each of the row electrodes. The gate-on pulse has a pulse waveform which includes at least one concave portion during a horizontal period.

Alternatively, the driving apparatus and method of this invention for an active matrix type liquid crystal display apparatus having row and column electrodes includes the step of applying a gate-one pulse for writing data for one line to the column electrodes to each of the row electrodes. The gate-on pulse varies between a first level and a second level at least two times during a horizontal period.

In a preferred embodiment, the horizontal period may include three periods, a first period, a second period and a third period in this order. The gate-on pulse is at the first level during the first period, at the second level during the second period and at the first level during the third period.

According to the above-mentioned driving apparatus and method of the invention, the charging efficiency to the liquid crystal layer per unit time period is improved according to the invention. Accordingly, the driving apparatus and method of the invention is suitable for an LCD apparatus in which the gate-on period is shortened and the scanning ability would be improved, because the liquid crystal layer is always sufficiently charged, and the display contrast can be improved.

Thus, the invention described herein makes possible the advantage of providing a driving apparatus and method for an active matrix type LCD apparatus in which the charging efficiency to a liquid crystal layer per unit period time is improved, and hence the scanning ability and the display quality can be improved.

These and other advantages of the present invention will become apparent to those skilled in the art upon reading and understanding the following detailed description with reference to the accompanying figures.

DESCRIPTION OF THE PREFERRED EMBODIMENTS

Figure 1:
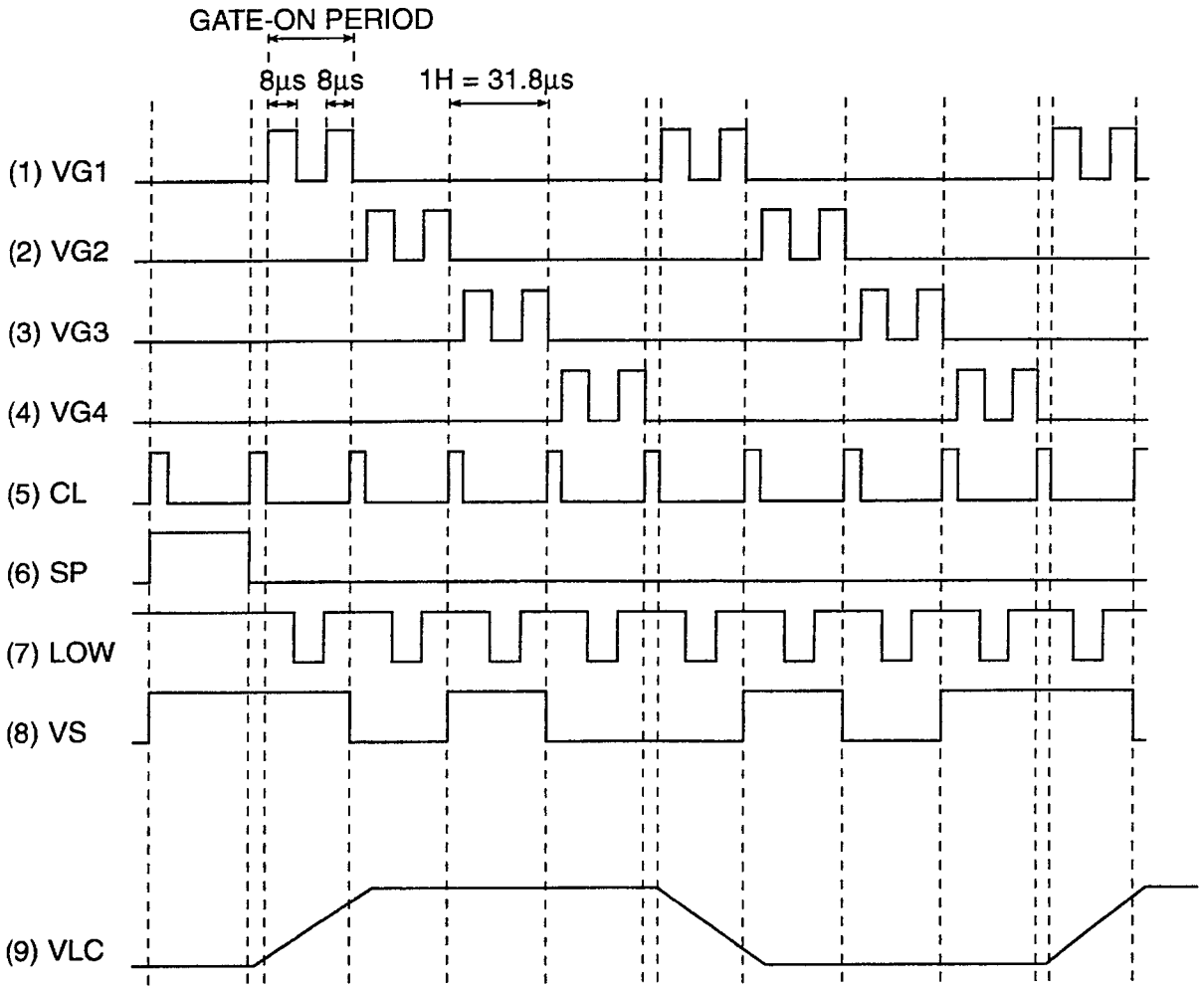
FIG. 1 shows signal waveforms illustrating a driving method for an active matrix type LCD apparatus of the invention.

FIG. 1 shows a driving method for an active matrix type LCD apparatus of the invention. The configuration of the active matrix type LCD apparatus to which the method of the invention is applied is the same as that of the active matrix type LCD apparatus shown in FIG. 3. A row electrode driving circuit has the same configuration as that of the row electrode driving circuit shown in FIG. 4. The detailed description of the configuration is omitted and like components have like reference numerals.

In FIG. 1, first to fourth waveforms represent gate-on pulses VG1–VG4 respectively output from the row electrode driving circuit 30 onto the row electrodes 1–4. In these gate-on pulses VG1–VG4, one horizontal scanning period (1H) coincides with one-half of the period of the NTSC television signal (1H)=about 31.8 μs). That is, the length of one horizontal scanning period is the same as that used in the prior art method of FIG. 6.

These gate-on pulses VG1–VG4 are produced by inputting a clock pulse CL of a fifth waveform, data SP of a sixth waveform, and a LOW signal of a seventh waveform into the respective input terminals of the row electrode driving circuit 30, as in the prior art method. The gate-on period of each of the gate-on pulses VG1–VG4 is 24 μs which is the same as in the prior art method. However, each of the gate-on pulses VG1–VG4 has a pulse waveform including a concave portion during the gate-one period. Specifically, each of the pulses are set to be a LOW level during one-third of the gate-on period (i.e., the intermediate 8 μs period), as shows in FIG. 1. Accordingly, each of the gate-on pulses VG1–VG4 has a pulse waveform including two HI periods and one LOW period(8 μs) therebetween. The length of one of the HI periods is obtained by subtracting the intermediate period from the gate-on period, and by dividing the subtracted result into two equal periods, i.e., (24–8)/2=8 μs.

The gate-on pulses VG1–VG4having such pulse waveforms may be produced by superimposing the LOW signal of the seventh waveform on the gate-on pulses VG1–VG4 produced by the use of the prior art method. As shown by the seventh waveform, the polarity of the LOW signal is inverted in the intermediate period of the gate-on period.

Figure 3:
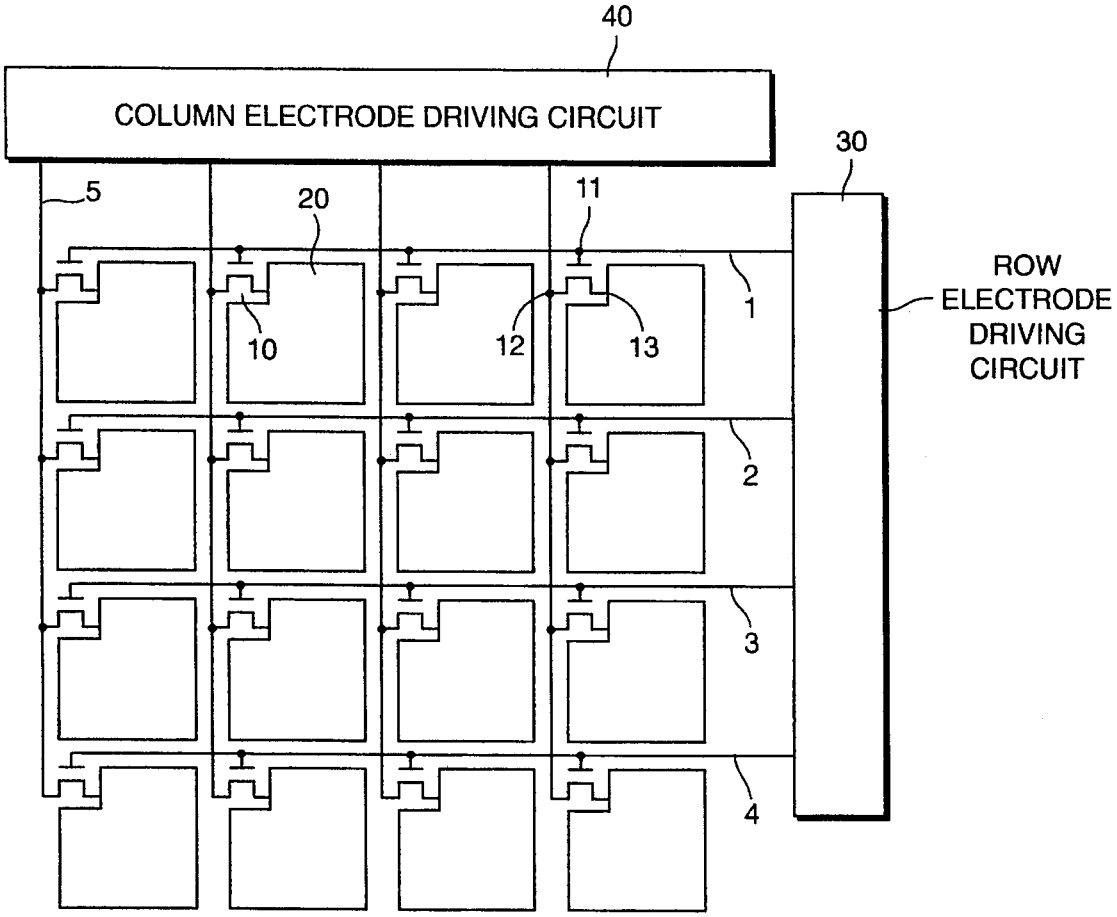
Fig. 3 (PRIOR ART)
FIG. 3 shows a schematic configuration of the active matrix type LCD apparatus.
Figure 4:
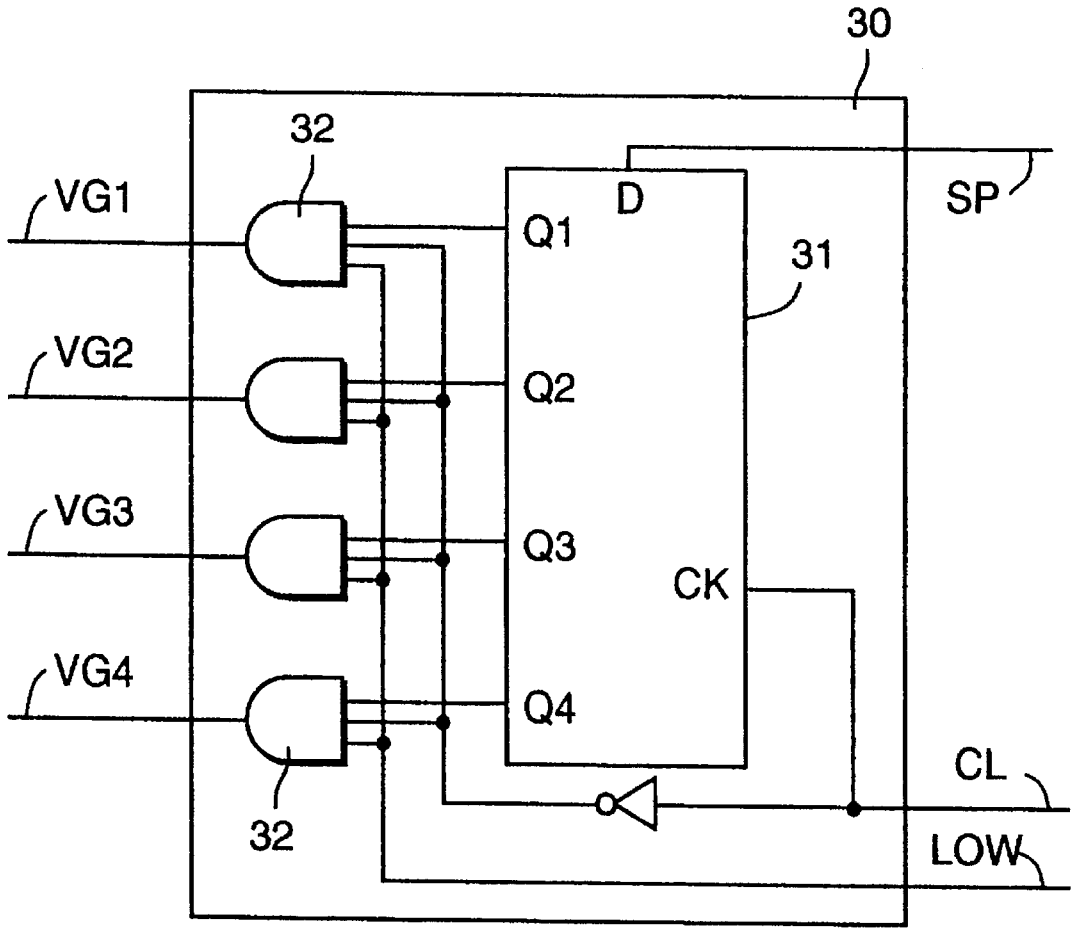
Fig. 4 (PRIOR ART)
FIG. 4 shows a schematic configuration of a row electrode driving circuit.
Figure 5:
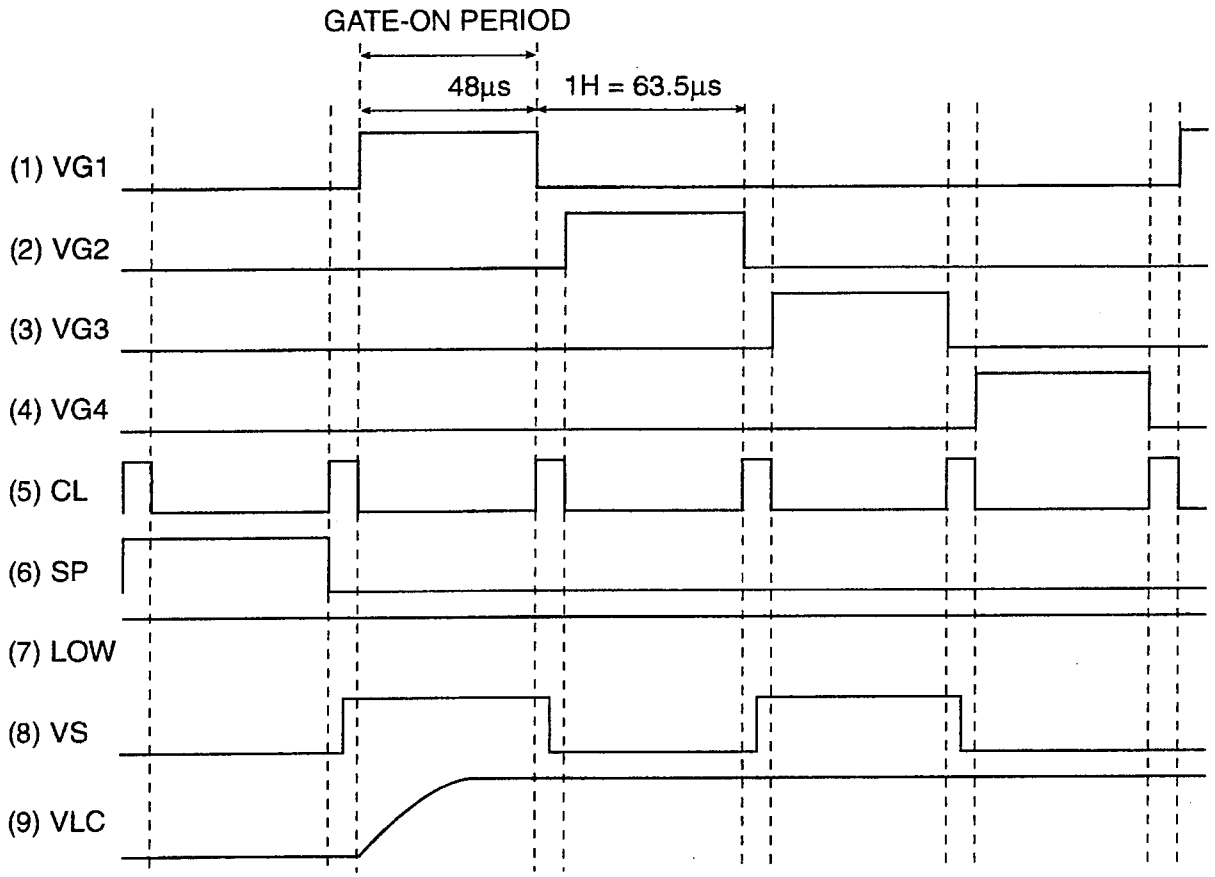
Fig. 5 (PRIOR ART)
FIG. 5 shows signal waveforms showing the prior art driving method.
Figure 6:
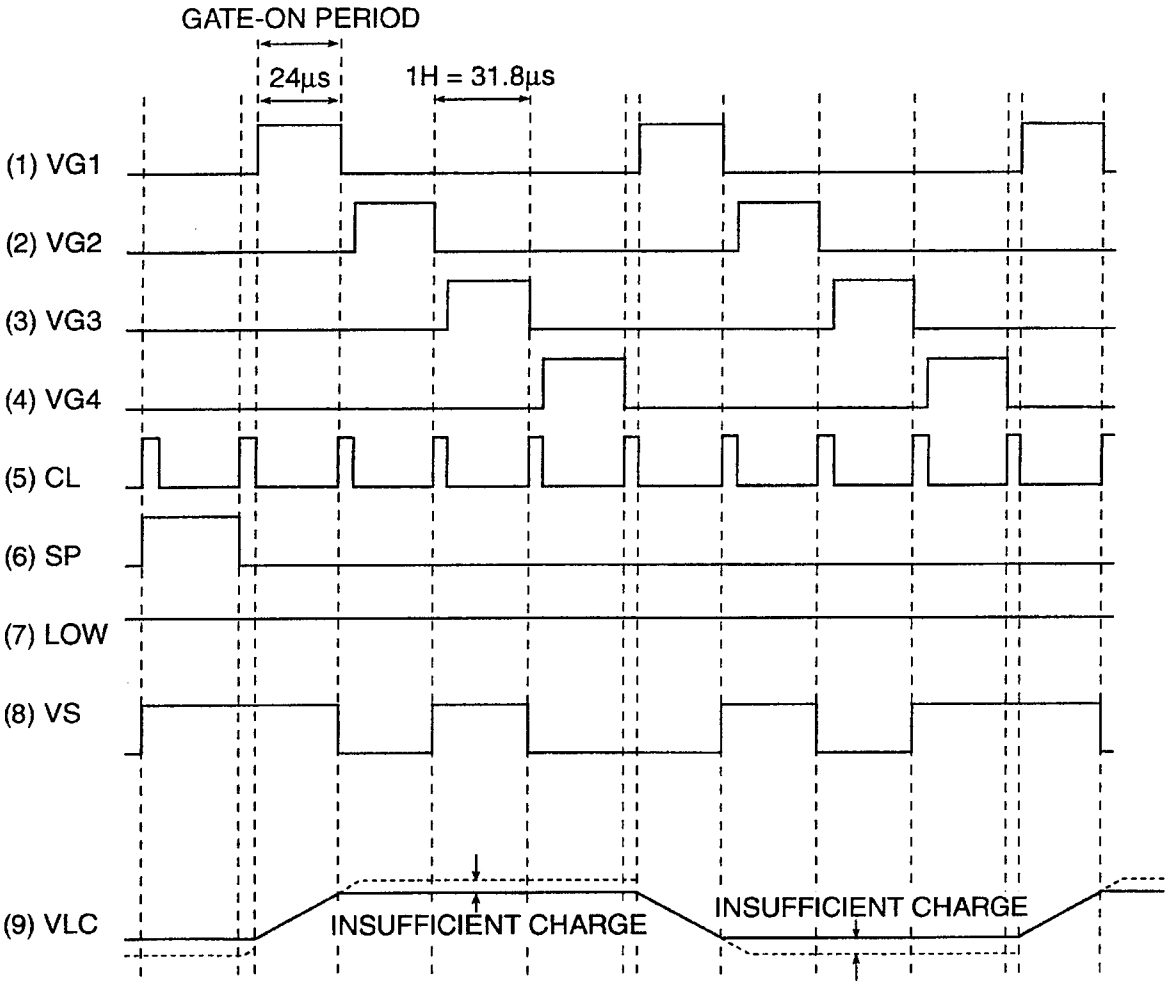
Fig. 6 (PRIOR ART)
FIG. 6 shows signal waveforms showing a prior art driving method in which a gate-on period is shortened.

As shown by an eighth waveform in FIG. 1, the waveform of a signal VS to be applied to each of the column electrodes 5 shown in FIG. 3 is the same as that of the prior art method shown in FIG. 6.

Figure 2:
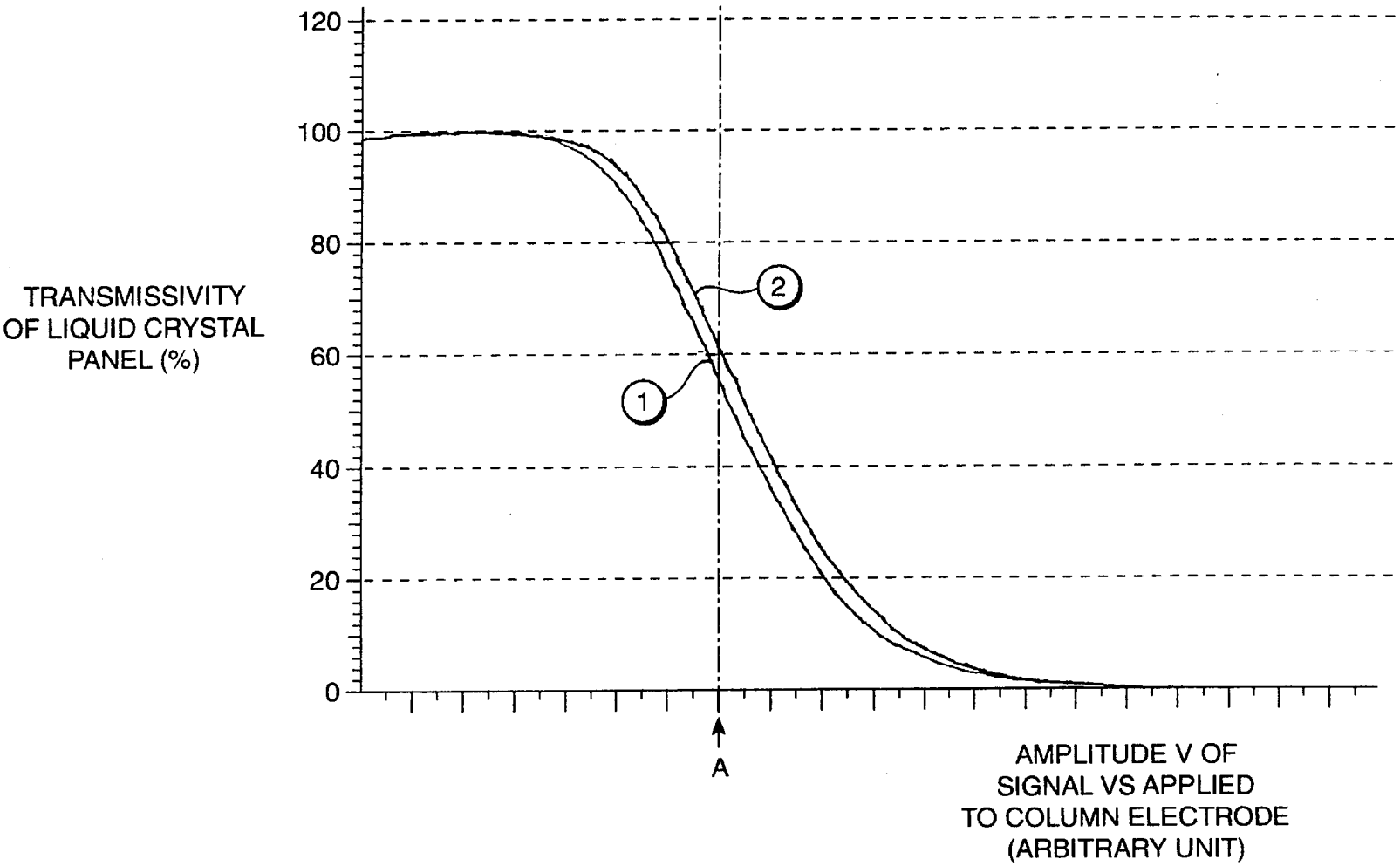
FIG. 2 is a graph comparatively showing a transmissivity curve of a liquid crystal panel in the method of the invention and a transmissivity curve in a prior art method.

When the signal VS of the same level is applied to the same column electrode 5 both in the method of the invention and in the prior art method of FIG. 6, the charging efficiency to a liquid crystal layer in the method of the invention can be improved as compared with the prior art method for the following reasons with reference to the graph shown in FIG. 2. In FIG. 2, the vertical axis represents a transmissivity of a liquid crystal panel (%) and the horizontal axis represents an amplitude V of the signal VS applied to a column electrode (arbitrary unit). In FIG. 2, a transmissivity in the method of the invention is shown by a curve ①, and a transmissivity in the prior art method is also shown by a curve ② for comparison. The transmissivity is measured by using a transmission type LCD apparatus of a normally white system.

Since the transmissivity is measured by using an LCD apparatus of a normally white system as described above, it is decreased as the level of the signal VS is increased. As seen from the curves ① and ② at the point indicated by A in FIG. 2, the transmissivity in the method of the invention is lower than that in the prior art method.

In the case of the LCD of a normally white system, the lower transmissivity at the same level of the voltage applied to a column electrode means that the level of a voltage applied to the liquid crystal layer is increased. That is, the charging efficiency to the liquid crystal layer is superior. More specifically, as seen from FIG. 2, the charging efficiency to the liquid crystal layer can be improved in the method of the invention, as compared with the prior art method. Accordingly, it is clear by comparing the ninth waveform in FIG. 1 with the ninth waveform in FIG. 6 that insufficient charge does not occur when the invention is applied to an LCD apparatus in which the scanning is performed with a shortened gate-on period.

In the above embodiment, the gate-on pulse has a pulse waveform including a concave portion in a horizontal period. Alternatively, the gate-on pulse may have a pulse wave form which is divided into a plurality of portions and includes at least one concave portion during a horizontal period.

As described above, according to the driving method for an active matrix type LCD apparatus of the invention, the charging efficiency to a liquid crystal layer per unit time period can be improved as compared with the prior art method. Accordingly, the driving method of the invention is suitable for an LCD apparatus in which the gate-on period is shortened and the scanning ability is attempted to be improved, because the liquid crystal layer is always sufficiently charged and hence the display contrast can be improved.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A driving method for an active matrix type liquid crystal display apparatus having row and column electrodes, said driving method comprising the step of:

applying a gate-on pulse to each of said row electrodes for writing date for one line from said column electrodes, wherein each of said row electrodes is connected to a gate of a switching transistor, each of said column electrodes is connected to a source of the switching transistor, and a voltage is applied to pixels disposed in the matrix via the switching transistors, and said gate-on pulse having a pulse waveform which includes at least one concave portion within a gate-on period during a horizontal period H, said horizontal period H is T/n, where T is time for scanning all of said row electrodes and n is a number of said row electrodes.

2. A driving method for an active matrix type liquid crystal display apparatus having row and column electrodes, said driving method comprising the step of:

applying a gate-on pulse to each of said row electrodes for writing data for one line from said column electrodes, wherein each of said row electrodes is connected to a gate of a switching transistor, each of said column electrodes is connected to a source of the switching transistor, and a voltage is applied to pixels disposed in the matrix via the switching transistors, and said gate-on pulse varying between a first level and a second level at least four times during a horizontal period H and keeping a constant voltage which has a level equal to one of said first level and said second level during a period other than said horizontal period H, said horizontal period H is T/n, where T is time for scanning all of said row electrodes and n is a number of said row electrodes.

3. The method according to claim 2, wherein said horizontal period H includes three periods, a first period, a second period and a third period in this order, said gate-on pulse being at said first level during said first period, at said second level during said second period and at said first level during said third period.

4. A driving apparatus for an active matrix type liquid crystal display having row and column electrodes, said driving apparatus comprising:

means for applying a gate-on pulse to each of said row electrodes for writing data for one line from said column electrodes, said gate-on pulse having a pulse waveform which includes at least one concave portion within a gate-on period during a horizontal period H, said horizontal period H is T/n, where T is time for scanning all of said row electrodes and n is a number of said row electrodes, wherein each of said row electrodes is connected to a gate of a switching transistor, each of said column electrodes is connected to a source of the switching transistor, and a voltage is applied to pixels disposed in the matrix via the switching transistors.

5. A driving apparatus for an active matrix type liquid crystal display having row and column electrodes, said driving apparatus comprising:

means for applying a gate-on pulse to each of said row electrodes for writing data for one line from said column electrodes, said gate-on pulse varying between a first level and a second level at least four times during a horizontal period H and keeping a constant voltage which has a level equal to one of said first level and said second level during a period other than said horizontal period H, said horizontal period H is T/n, where T is time for scanning all of said row electrodes and n is a number of said row electrodes, and wherein each of said row electrodes is connected to a gate of a switching transistor, each of said column electrodes is connected to a source of the switching transistor, and a voltage is applied to pixels disposed in the matrix via the switching transistors.

6. The apparatus according to claim 5, wherein said horizontal period H includes three periods, a first period, a second period and a third period in this order, said gate-on pulse being at said first level during said first period, at said second level during said second period and at said first level during said third period.

7. The method according to claim 1, wherein a level of voltage applied to each of said column electrodes is constant during said horizontal period H.

8. The method according to claim 2, wherein a level of voltage applied to each of said column electrodes is constant during said horizontal period H.

9. The apparatus according to claim 4, wherein a level of voltage applied to each of said column electrodes is constant during said horizontal period H.

10. The apparatus according to claim 5, wherein a level of voltage applied to each of said column electrodes is constant during said horizontal period H.

11. A driving method for an active matrix type liquid crystal display apparatus having row and column electrodes, said driving method comprising the step of:

applying a gate-on pulse to each of said row electrodes for writing data for one line from said column electrodes, wherein each of said row electrodes is connected to a gate of a switching transistor, each of said column electrodes is connected to a source of the switching transistor, and a voltage is applied to pixels disposed in the matrix via the switching transistors, and said gate-on pulse including a plurality of spaced pulse waveforms during a horizontal period H, said horizontal period H is T/n, where T is time for scanning all of said row electrodes and n is a number of said row electrodes.

12. The method according to claim 11, wherein a level of voltage applied to each of said column electrodes is constant during said horizontal period H.

13. A driving apparatus for an active matrix type liquid crystal display having row and column electrodes, said driving apparatus comprising:

means for applying a gate-on pulse to each of said row electrodes for writing data for one line from said column electrodes, said gate-on pulse including a plurality of spaced pulse waveforms during a horizontal period H, said horizontal period H is T/n, where T is time for scanning all of said row electrodes and n is a number of said row electrodes, wherein each of said row electrodes is connected to a gate of a switching transistor, each of said column electrodes is connected to a source of the switching transistor, and a voltage is applied to pixels disposed in the matrix via the switching transistors.

14. The apparatus according to claim 13, wherein a level of voltage applied to each of said column electrodes is constant during said horizontal period H.

* * * * *